US006584617B1

(12) United States Patent
Turner

(10) Patent No.: US 6,584,617 B1
(45) Date of Patent: Jul. 1, 2003

(54) SWEATER WRAP

(76) Inventor: Augustavia Y. Turner, 7431 Pipers Way, Unit 9, Downers Grove, IL (US) 60516

( * ) Notice: Subject to any disclaimer, the term of this patent is extended or adjusted under 35 U.S.C. 154(b) by 0 days.

(21) Appl. No.: 10/124,793

(22) Filed: Apr. 17, 2002

(51) Int. Cl.[7] ..... A41D 3/08
(52) U.S. Cl. ..... 2/88; 2/207
(58) Field of Search ..... 2/279, 88, 207, 2/89, 90, 92, 119, 121, 127, 137; D2/500, 501, 502, 600, 605

(56) References Cited

U.S. PATENT DOCUMENTS 1,586,077 A * 11/1926 Evans ..... 119/850
2,639,431 A * 5/1953 Spear ..... 2/88
2,804,626 A * 9/1957 Rossiter ..... 2/91
4,780,912 A * 11/1988 Harmsen ..... 2/91
6,226,799 B1 * 5/2001 Lane ..... 2/207
6,240,562 B1 * 6/2001 Martin ..... 2/88
D445,993 S * 8/2001 Raol ..... D5/500
6,477,988 B2 * 11/2002 Burnett ..... 2/207
6,496,985 B1 * 12/2002 Faldet ..... 2/50

* cited by examiner

*Primary Examiner*—John J. Calvert
*Assistant Examiner*—Alissa L. Hoey
(74) *Attorney, Agent, or Firm*—Brian R. Rayve

(57) ABSTRACT

A non-bunching sweater wrap for wearing by a person over the person's outer cloths that drapes over the upper back and shoulders around the neck of the person to simulate a sweater. The sweater wrap includes a generally rectangular body having a lower edge, a pair of side edges, and an upper portion. A pair of elongate parallel arms extend upwardly from the upper portion, the arms having straight outer edges which are parallel and inner edges which include respective outwardly upwardly curved portions to closely fit around the person's neck positioned adjacent the body of the sweater wrap. The body of he sweater wrap may be secured in position over the person's outer cloths by tying the arms into a knot at the person's upper chest without resulting in an inward bunching of the upper portion of the body and the arms behind and beside the person's neck.

20 Claims, 2 Drawing Sheets

SWEATER WRAP

BACKGROUND OF THE INVENTION

1. Field

Figure 2:
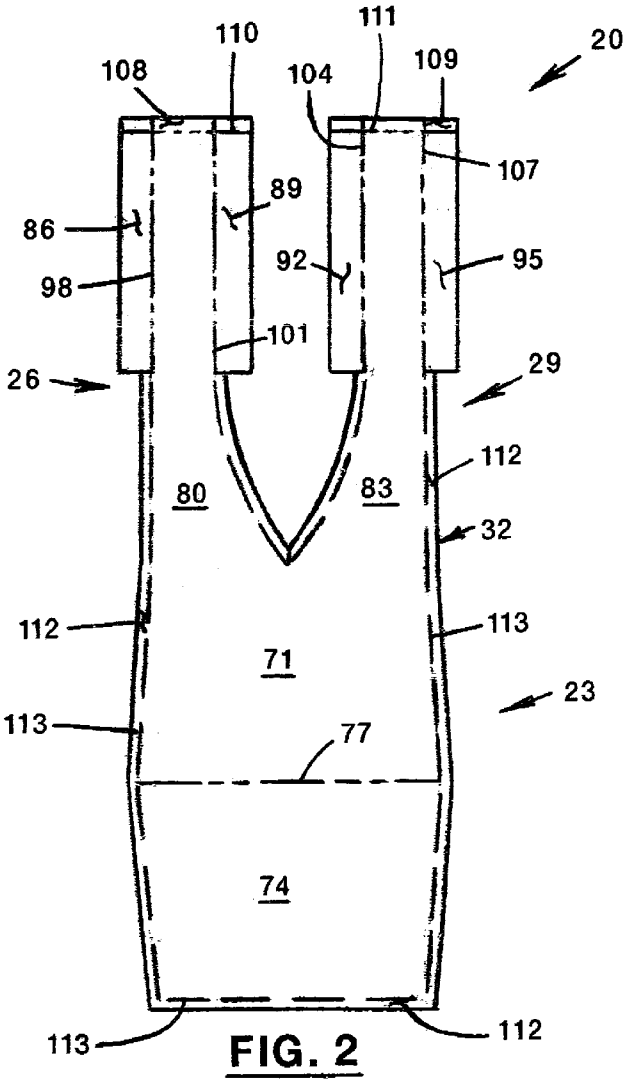

The present invention relates to clothing and more specifically to sweaters and shawls which are worn over other clothing.

2. State of the Art

Peoples' tastes in clothing and clothing styles are an elusive target which clothing designers, clothing retailers, and other such people have attempted to predict and oftentimes try to set. While some styles are set each year by the big name clothing designers, other styles simply emerge due to peoples' habits. One such style which arose due to people's habits is the wearing of a sweater tied around a person's shoulders or waist when too hot to be worn. The sweater may be untied and worn in case the weather becomes colder such as by becoming cloudy or raining, since the outer clothing worn lacks sufficient insulation for such colder weather. The sweater may be draped over the person's shoulders and the arms of the sweater tied in front of the person's upper chest, or draped behind the person's buttocks and the arms of the sweater tied in front of the person's waist. This keeps the sweater handy for use should the weather turn colder, but does not require carrying of the sweater in the hands or around the arms of the person. The sweater worn draped over the shoulders or wrapped around the waist has become fashionable, particularly with women, who wear the sweaters for the stylish look and not because a sweater might be needed.

While many people like the stylish look created by wearing the sweater tied about them, they are not pleased by the bulkiness of the sweater. When draped over the shoulders, considerable bunching occurs at the juncture of the arms and the body of the sweater. This is because the arms extend laterally and downwardly of the body, but when worn draped over the shoulders, the arms must be rotated about one-hundred-thirty-five degrees from their normal position to wrapped about the person's neck. Bunching or cupping occurs at a bottom portion of the body where respective front and rear portions of the body are juxtaposed.

Various garments have been designed which look like a sweater when worn tied about the person, but which are actually not real sweaters that can be worn as such which attempt to eliminate bunching problems. For example, in U.S. Pat. No. 6,240,562 issued to Martin is disclosed a shawl type garment which is designed to simulate a sweater. The garment includes a main body panel and a pair of arms which extend laterally at a right angle from an upper portion of the main body panel. The garment is of a woven or knitted fabric that is either single or double layered. The garment is cut to minimize cupping at the bottom edge and can include trim buttons and button holes to simulate a cardigan sweater. While this garment may be an improvement over tying a real sweater by minimizing cupping at the bottom edge when tied around the person, there is still the problem of bunching at the juncture of the arms and the main body panel. That is, since the arms extend at a right angle laterally of the main body panel, there is considerable bunching at the juncture of the arms and the main body panel when the garment is worn draped over the shoulders. That is because the arms must be rotated ninety degrees from their lateral position to wrapped about the person's neck and be tied.

In U.S. Pat. No. 1,586,077 issued to Evans is disclosed a garment which is a combined muffler and scarf. The garment consists of a rectangular back section and two elongate rectangular muffler portions which are integrally formed with the back section or permanently attached thereto. The muffler portions extend in a spaced parallel relationship from an upper portion of the back section. A button or other fastening device is provided in the center of a lower edge of the back section. One muffler portion is provided with three loops at a distal end from the back section and the other muffler portion is provided with a loop and two buttons also at a distal end from the back section. When worn, the back section extends from the wearer's shoulders down to the small of the back and the two muffler portions pass over the shoulders and are crossed over the chest and extend along the lower edge of the back section. The muffler ends are connected together using the buttons which fasten in the respective loops and the loops fasten over the button of the back section to attach the ends of the muffler portions to the back section to prevent the ends of the muffler from riding up when worn. The garment is not designed to look like a sweater, and does not look like a sweater. The muffler portions of the garment do not tie in front of the person wearing the garment, but rather requires fastening devices to secure the ends of the muffler portions behind the person.

There is a need for a garment which simulates a sweater when worn draped over the person's shoulders and tied in front, but which does not bunch at the juncture of the arms and the body when worn as such.

SUMMARY OF THE INVENTION

The present invention is a non-bunching sweater wrap for wearing by a person over the person's outer cloths that drapes over the upper back and shoulders around the neck of the person to simulate a sweater. The sweater wrap includes a generally rectangular body having a lower edge, a pair of side edges, and an upper portion. A pair of elongate arms extend upwardly from the upper portion, each arm having an outer edge and an inner edge. The body may be secured in position over the person's outer cloths by tying the arms into a knot at the upper chest of the person without resulting in an inward bunching of the upper portion of the body and the arms behind and beside the person's neck. The arms are preferably parallel with the respective inner edges including respective outwardly upwardly curved portions adjacent the body, and the outer edges substantially straight and parallel.

THE DRAWINGS

Figure 1:
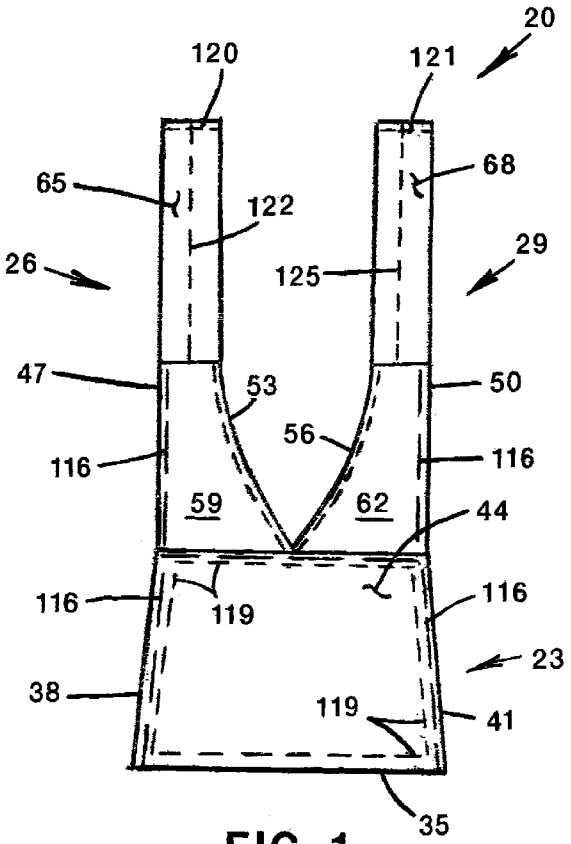
Figure 3:
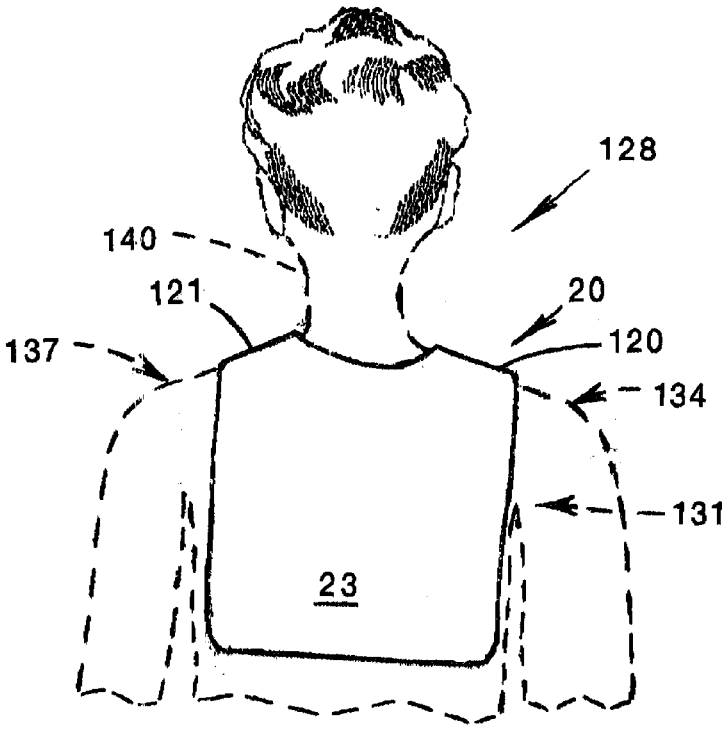
Figure 4:
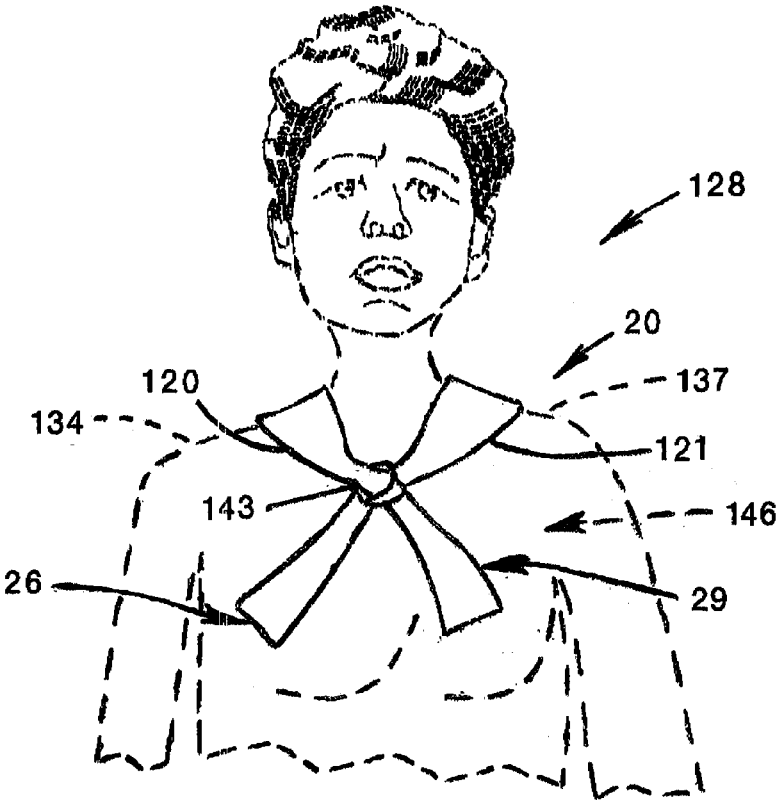

The best mode presently contemplated for carrying out the invention is illustrated in the accompanying drawings, in which:

FIG. 1 is a top plan view of an exemplary sweater wrap in accordance with the present invention;

FIG. 2, a top plan view of a blank of fabric used to make the sweater wrap;

FIG. 3, a rear elevational view of the sweater wrap as worn by the person; and FIG. 4, a front elevational view of the sweater wrap as worn by a person.

DETAILED DESCRIPTION OF THE ILLUSTRATED EMBODIMENTS

As shown in FIG. 1, therein is shown an exemplary sweater wrap in accordance with the invention, designated generally at 20, comprising a tapered body 23 and a pair of upwardly dependent arms 26 and 29. The sweater wrap 20 is preferably made of a single fabric blank 32 of a woven fabric such as wool, fleece, polyester, cotton, or cotton blend, which is cut, folded, and seamed. The body 23 is of a double thickness of fabric, having a straight lower edge 35, a pair of inwardly upwardly tapered side edges 38 and 41, and an upper portion 44. The arms 26 and 29 extend upwardly from the upper portion 44, having respective straight outer edges 47 and 50, and respective outwardly upwardly curved inner edges 53 and 56. Each arm 26 and 29 includes a respective single fabric thickness portion 59 and 62 adjoining the body 23 and respective tubular portions 65 and 68 distal from the body 23. The proportions of the body 23 and the arms 26 and 29 is comparable to standard sweater sizes.

Referring to FIG. 2, therein is shown the fabric blank 32 prior to folding and seaming. The body 23 is comprised respective first and second body blank portions 71 and 74 which are separated at a fold line 77. The arms 26 and 29 are comprised of respective center blank portions 80 and 83, with respective pairs of upper blank tabs 86 and 89, and 92 and 95 which are separated therefrom by fold lines 98, 101, 104, and 107 to form the respective tubular portions 65 and 68. Respective cuff portions 108 and 109 are separated from center blank portions 80 and 83 by respective fold lines 110 and 111. A peripheral blank edge portion 112 extends around fabric blank 23, being separated therefrom by a peripheral fold line 113.

The sweater wrap 20 is formed from the fabric blank 32 by folding along the peripheral fold line 113 and sewing a peripheral blank seam 116. The second body portion 74 is then folded at the fold line 77 onto the first body portion 71 and sewn at a peripheral body seam 119. The cuff portions 108 and 109 are then folded at the respective fold lines 110 and 111 and sewn at respective cuff seams 120 and 121. The tabs 86 and 89 are then folded at the respective fold lines 98 and 101 and sewn together at a first arm seam 122. The tabs 92 and 95 are then folded at the respective fold lines 104 and 107 and sewn together at a second arm seam 125. The size of the fabric blank 32 can be adjusted to produce sweater wraps comparable to standard small, medium, large, X-large, etc. sizes of regular sweaters to suit individual persons.

Referring to FIGS. 3 and 4, the sweater wrap 20 is shown as worn over by a person 128. The sweater wrap 20 drapes over the upper back 131 and shoulders 134 and 137 around the neck 140 of the person 128. The arms 26 and 29 are tied into a knot 143 at the upper chest 146 of the person. The sweater wrap 20 does not bunch at the juncture of the arms 26 and 29, and the body when worn draped over the person's shoulders and tied in front. This is because the arms 26 and 29 extend in a parallel manner upwardly from the body 23 so as to not require bending in the plane of the fabric which is the cause of bunching. Rather, the arms 26 and 29 are bent perpendicularly of the plane of the fabric over the shoulders 134 and 137 which produces no bunching. Furthermore, the single fabric thickness portions 59 and 62 of each arm 26 and 29 adjoining the body 23 wrap over the shoulders 134 and 137, the single thickness of fabric additionally reducing over a double thickness any tendency toward bunching and reducing the thickness of the sweater wrap 20 over the shoulders 134 and 137 of the person 128 providing further comfort. The tubular portions 65 and 68 of the respective arms 26 and 29 retain the look of a real sweater as viewed from the front while eliminating the bunching problem. The outwardly upwardly curved inner edges 53 and 56 fit about the neck 140 of the person 128 to close the area around the neck 140 as would be the case with a real sweater with the associated bunching around the neck 140, but which would be left open using the sweater wrap 20 if the inner edges 53 and 56 were not curved, leaving a rectangular opening (not shown). Therefore, the sweater wrap 20 provides the stylish, casual look of a draped and/or tied sweater, but without the bulk at the juncture of the arms 26 and 29, and the body 23. The sweater wrap 20 can also be worn about the person's waist (not shown) though not specifically designed to reduce bunching when worn there.

Many variations of the sweater wrap of the present invention can be made while staying within the same inventive concept. For example, while the sweater rap shown is designed to simulate a regular pullover type sweater, the sweater wrap can be adapted to simulate a cardigan sweater wherein the body includes a plurality of buttons arranged along one side edge and a plurality of button holes along the opposite side edge. The sweater wrap may be made of any fabric, woven or knit, and can be made in a single thickness or in a double thickness. The fabric may include decorative patterns woven in or otherwise applied thereto such as embroidered or sewn on as a patch. While the bottom edge of the sweater wrap is preferably folded and straight to minimize bunching, the bottom edge may also be curved, the first and second body blank panels being sewn together if so desired.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A non-bunching sweater wrap for wearing by a person over the person's outer cloths that drapes over the upper back and shoulders around the neck of the person to simulate a sweater, comprising:

a generally rectangular body having a lower edge, a pair of side edges, and an upper portion;

a pair of elongate substantially parallel arms that extend upwardly from said upper portion, said arms having each having an outer edge and an inner edge; and wherein said body may be secured in position over the person's outer cloths by tying the arms into a knot at the upper chest of the person without resulting in an inward bunching of said upper portion of said body and said arms behind and beside the person's neck.

2. The sweater wrap according to claim 1, wherein each arm includes a single fabric thickness portion adjoining the body.

3. The sweater wrap according to claim 2, wherein each arm includes a tubular portion distal from the body.

4. The sweater wrap according to claim 3, wherein each tubular portion terminates in a cuff distal from the body.

5. The sweater wrap according to claim 3, wherein the tubular portions of the arms include a center portion and a pair of laterally extending tabs which are folded at respective fold lines and sewn together to form said tubular portions.

6. The sweater wrap according to claim 1, wherein the body comprises a double thickness of fabric.

7. The sweater wrap according to claim 6, wherein the double thickness of fabric at the bottom edge of the body is fastened together so as to be closed.

8. The sweater wrap according to claim 7, wherein the lower edge of the body is substantially straight and perpendicular to the arms.

9. The sweater wrap according to claim 8, wherein the body is comprised of respective first and second body portions which are folded on a fold line therebetween at the lower edge of said body to produce the double thickness of fabric of said body.

10. The sweater wrap according to claim 1, wherein the inner edges of the arms include respective outwardly upwardly curved portions adjacent the body.

11. The sweater wrap according to claim 10, wherein the outer edges of the arms are substantially straight and parallel.

12. A non-bunching sweater wrap for wearing by a person over the person's outer cloths that drapes over the upper back and shoulders around the neck of the person to simulate a sweater, comprising:

a generally rectangular body having a lower edge, a pair of side edges, and an upper portion;

a pair of elongate substantially parallel arms that extend upwardly from said upper portion, said arms having each having an outer edge and an inner edge; and wherein the sweater wrap comprises a single fabric blank which is cut, folded, and seamed, and wherein said body may be secured in position over the person's outer cloths by tying the arms into a knot at the upper chest of the person without resulting in an inward bunching of said upper portion of said body and said arms behind and beside the person's neck.

13. The sweater wrap according to claim 12, wherein a peripheral blank edge portion extends around most of the fabric blank which is folded at a peripheral fold line and sewn together.

14. The sweater wrap according to claim 12, wherein each arm includes a single fabric thickness portion adjoining the body.

15. The sweater wrap according to claim 14, wherein each arm includes a tubular portion distal from the body, and wherein said tubular portions each include a center portion and a pair of laterally extending tabs which are folded at respective fold lines and sewn together to form said tubular portions.

16. The sweater wrap according to claim 15, wherein the body comprises a double thickness of fabric, said double thickness of fabric at the bottom edge of said body being fastened together so as to be closed and being substantially straight and perpendicular to the arms, said body comprising respective first and second body portions which are folded on a fold line therebetween at said lower edge of said body to produce said double thickness of fabric of said body.

17. The sweater wrap according to claim 12, wherein the inner edges of the arms include respective outwardly upwardly curved portions adjacent the body and the outer edges of said arms are substantially straight and parallel.

18. A non-bunching sweater wrap for wearing by a person over the person's outer cloths that drapes over the upper back and shoulders around the neck of the person to simulate a sweater, comprising:

a generally rectangular body having a lower edge, a pair of side edges, and an upper portion;

a pair of elongate arms that extend upwardly from said upper portion, said arms having each having an outer edge and an inner edge; and wherein said body may be secured in position over the person's outer cloths by tying the arms into a knot at the upper chest of the person without resulting in an inward bunching of said upper portion of said body and said arms behind and beside the person's neck.

19. The sweater wrap according to claim 18, wherein each arm includes a single fabric thickness portion adjoining the body, and wherein the inner edges of said arms include respective outwardly upwardly curved portions adjacent said body and the outer edges of said arms are substantially straight and parallel.

20. The sweater wrap according to claim 19, wherein each arm includes a single fabric thickness portion adjoining the body and a tubular portion distal from said body, said body comprising a double thickness of fabric wherein said double thickness of fabric at the bottom edge of said body is fastened together so as to be closed.

* * * * *